US009324315B2

(12) United States Patent
Yuen

(10) Patent No.: US 9,324,315 B2
(45) Date of Patent: Apr. 26, 2016

(54) LOUDSPEAKER DIAPHRAGM AND LOUDSPEAKER USING SAME

(75) Inventor: Shunming Yuen, Hong Kong (CN)

(73) Assignee: INNOVATION SOUND TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 14/355,864

(22) PCT Filed: Jun. 4, 2012

(86) PCT No.: PCT/CN2012/076440

§ 371 (c)(1), (2), (4) Date: Jun. 16, 2014

(87) PCT Pub. No.: WO2013/063932

PCT Pub. Date: May 10, 2013

(65) Prior Publication Data

US 2015/0075900 A1 Mar. 19, 2015

(30) Foreign Application Priority Data

Nov. 3, 2011 (CN) ..... 2011 2 0430959 U

(51) Int. Cl.
*H04R 1/22* (2006.01)
*G10K 13/00* (2006.01)
(Continued)

(52) U.S. Cl.
CPC ..... *G10K 13/00* (2013.01); *H04R 7/125* (2013.01); *H04R 1/1075* (2013.01); *H04R 1/22* (2013.01); *H04R 2207/021* (2013.01); *H04R 2307/027* (2013.01); *H04R 2307/029* (2013.01); *H04R 2307/201* (2013.01); *H04R 2307/204* (2013.01)

(58) Field of Classification Search
USPC ..... 181/168, 170, 167; 381/423, 426, 427
See application file for complete search history.

(56) References Cited

U.S. PATENT DOCUMENTS 4,470,479 A * 9/1984 Inoue et al. ..... 181/168
4,646,874 A * 3/1987 Baitcher et al. ..... 181/169
(Continued)

FOREIGN PATENT DOCUMENTS

CN 1956603 A 5/2007
CN 101203064 A 6/2008
(Continued)

*Primary Examiner* — Edgardo San Martin
(74) *Attorney, Agent, or Firm* — Fitch, Even, Tabin & Flannery LLP

(57) ABSTRACT

The present invention relates to a type of vibrating membrane for speakers comprising the vibrating membrane body which comprises: A bottom layer used to reinforce the low frequency, a surface disposed on the said bottom layer, a composite metal layer used to ensure vibration uniformity, and a composite platy layer used for HF compensation disposed between the said bottom layer and the said composite metal layer. A type of speaker with the structure of the said vibrating membrane is also disclosed in the invention. Application of the vibrating membrane for speakers and the speaker using the said vibrating membrane as claimed in the invention could be such as to: enable excellent transient response speed, ensure vibration uniformity and obtain flat response in the working area; eliminate MF (medium frequency) and HF (high frequency) resonance to meet the full frequency band requirements of the headphone speakers; boast good flexural behavior to make the speaker structure more stable and less prone to deformation, thereby extending the service life and promoting the quality of the product.

10 Claims, 4 Drawing Sheets

(51) Int. Cl.

| | |
|---|---|
| ***H04R 7/12*** | (2006.01) |
| *H04R 1/00* | (2006.01) |
| *H04R 1/10* | (2006.01) |

(56) References Cited

U.S. PATENT DOCUMENTS

| | | | | | |
|---|---|---|---|---|---|
| 4,772,513 | A | * | 9/1988 | Sakamoto et al. | 428/408 |
| 5,259,036 | A | * | 11/1993 | Seeler | 381/426 |
| 5,744,761 | A | * | 4/1998 | Ogura et al. | 181/167 |
| 5,991,425 | A | * | 11/1999 | Anagnos | 381/423 |
| 6,327,372 | B1 | * | 12/2001 | Devantier et al. | 381/426 |
| 6,404,897 | B1 | * | 6/2002 | Devantier et al. | 381/426 |
| 6,929,092 | B2 | * | 8/2005 | Abe et al. | 181/168 |
| 7,274,798 | B2 | * | 9/2007 | Ohashi et al. | 381/430 |
| 7,539,324 | B2 | * | 5/2009 | Polfreman et al. | 381/423 |
| 7,687,411 | B2 | * | 3/2010 | Fujitani et al. | 442/59 |
| 8,284,964 | B2 | * | 10/2012 | Windischberger et al. | 381/150 |
| 8,385,584 | B2 | * | 2/2013 | Wang et al. | 381/423 |
| 2003/0021436 | A1 | * | 1/2003 | Wu | 381/426 |
| 2007/0071276 | A1 | * | 3/2007 | Kudo | 381/426 |
| 2009/0245546 | A1 | * | 10/2009 | Youn et al. | 381/190 |
| 2009/0304225 | A1 | * | 12/2009 | Kamimura et al. | 381/423 |
| 2011/0026757 | A1 | * | 2/2011 | Takahashi et al. | 381/397 |
| 2011/0155501 | A1 | * | 6/2011 | Chen | 181/167 |

FOREIGN PATENT DOCUMENTS

| | | | | | |
|---|---|---|---|---|---|
| CN | 201127114 | A | | 10/2008 | |
| CN | 201657271 | U | | 11/2010 | |
| CN | 102118671 | A | | 7/2011 | |
| JP | 56048799 | A | * | 5/1981 | H04R 7/10 |
| JP | 61088697 | A | * | 5/1986 | H04R 7/02 |
| JP | 63280600 | A | * | 11/1988 | H04R 7/02 |
| KR | 10-2005-0100852 | A | | 10/2005 | |
| KR | 100788476 | B1 | * | 12/2007 | H04R 7/125 |
| WO | WO 2010104250 | A1 | * | 9/2010 | |

* cited by examiner

LOUDSPEAKER DIAPHRAGM AND LOUDSPEAKER USING SAME

FIELD OF THE INVENTION

The present invention relates to a type of headphone speaker, more specifically, to a type of vibrating membrane for speakers and a type of speaker using the said vibrating membrane.

BACKGROUND OF THE INVENTION

Traditional vibrating membrane for headphone speakers is of a single layer structure and such a structure is made of homogeneous material which could be soft or hard, resulting in a narrow frequency band of the vibrating membrane for speakers. The situation could be such that, either the high frequency would suffice to produce clear and melodious sound or the low frequency would suffice to produce low but powerful sound, hence the inability to meet the full frequency band requirements of the headphone speakers.

In addition, the vibrating membrane for speakers of the prior art features unreasonable structure design, poor stability and liability of deformation, hence a short service life of the product.

DESCRIPTION OF THE INVENTION

The technical problem to be solved by the invention is to, provide a type of vibrating membrane for speakers and a type of speaker using the said vibrating membrane to enable excellent transient response speed, ensure vibration uniformity and obtain flat response in the working area; eliminate MF (medium frequency) and HF (high frequency) resonance to meet the full frequency band requirements of the headphone speakers.

Another technical problem to be solved by the invention is to render better flexural behavior and a more stable structure of the vibrating membrane for speakers to wane down the liability of deformation.

To solve the technical problem, a type of vibrating membrane for speakers comprising the vibrating membrane body is provided in the embodiments of the invention, which is characterized in that the said vibrating membrane body comprises: A bottom layer used to reinforce the low frequency, a surface disposed on the said bottom layer, a composite metal layer used to ensure vibration uniformity, and a composite platy layer used for HF compensation disposed between the said bottom layer and the said composite metal layer.

Preferably, the said vibrating membrane body comprises a circular top and the edge extended along the periphery of the said circular top.

Preferably, the said composite platy layer is disposed on the said circular top and its edges extend to the transitional part between the said circular top and the said edge.

Preferably, the said composite platy layer is disposed at the transitional part between the said circular top and the said edge.

Preferably, the said vibrating membrane body is of a single membrane structure.

Preferably, the said composite platy layer comprises a thin-film composite platy layer made of polyester resin.

Preferably, the said bottom layer comprises a thin-film bottom layer made of polyester resin.

Preferably, a copper ring is disposed on the edge of the said composite metal layer.

A type of speaker with the structure of the said vibrating membrane is also disclosed in the invention.

Application of the vibrating membrane for speakers and the speaker using the said vibrating membrane as claimed in the invention could render the beneficial effects as follows: the vibrating membrane for speakers as claimed in the invention is divided into three layers: the first is the bottom layer used to reinforce the low frequency, the second is the composite platy layer used for HF compensation and the third is the composite metal layer, wherein the former could be disposed either at the transitional part between the circular top and the edge or on the entire circular top and its edges at both ends extend to the transitional part between the circular top and the edge. The application could be such as to: enable excellent transient response speed, ensure vibration uniformity and obtain flat response in the working area; eliminate MF (medium frequency) and HF (high frequency) resonance to meet the full frequency band requirements of the headphone speakers; boast good flexural behavior to make the speaker structure more stable and less prone to deformation, thereby extending the service life and promoting the quality of the product.

BRIEF INTRODUCTION OF THE DRAWINGS

To illustrate the technical scheme in the embodiments of the invention or in the prior art in a clearer manner, a brief introduction to the accompanying drawings required for the description in the embodiments or the prior art will be made hereinafter. Obviously, the descriptions of the accompanying drawings hereafter are intended for some embodiments of the invention only and those skilled in the art could also obtain other accompanying drawings based on those attached herein without doing any creative work.

DETAILED DESCRIPTION OF THE PREFERRED EMBODIMENTS

Figure 1:
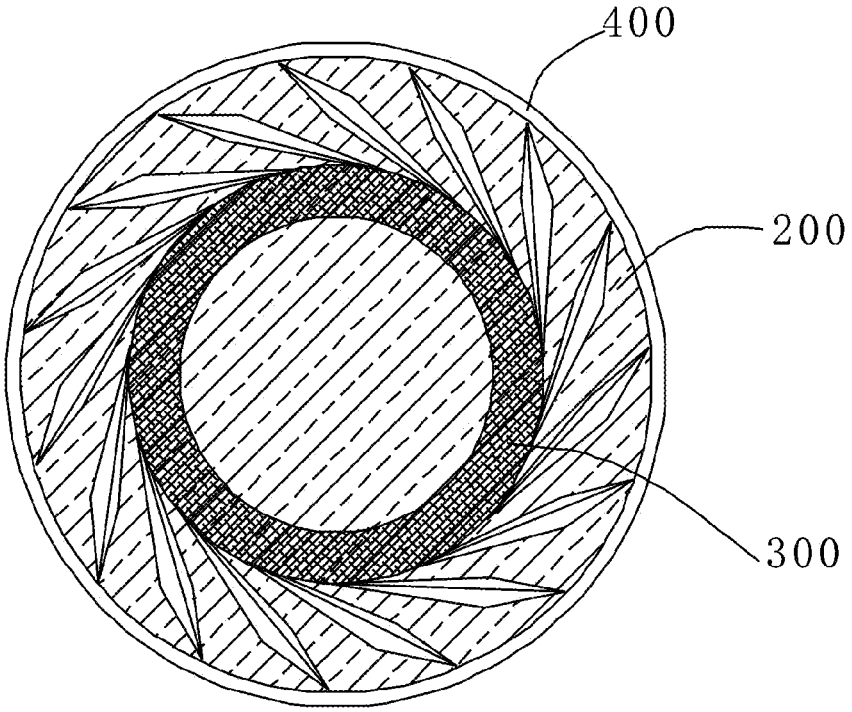
FIG. 1 is a schematic view of the first embodiment of the vibrating membrane for speakers as claimed in the invention.

The preferred embodiments of the invention are described hereinafter in reference to the accompanying drawings.

A type of vibrating membrane for speakers comprising the vibrating membrane body is disclosed in the invention, which is characterized in that, the said vibrating membrane body comprises: a bottom layer 100 used to reinforce the low frequency, a surface disposed on the said bottom layer 100, a composite metal layer 200 used to ensure vibration uniformity, and a composite platy layer 300 used for HF compensation disposed between the said bottom layer 100 and the said composite metal layer (200).

The vibrating membrane body of the vibrating membrane for speakers as claimed in the invention further comprises a circular top 1 and the edge 2 extended along the periphery of the said circular top 1.

Figure 2:
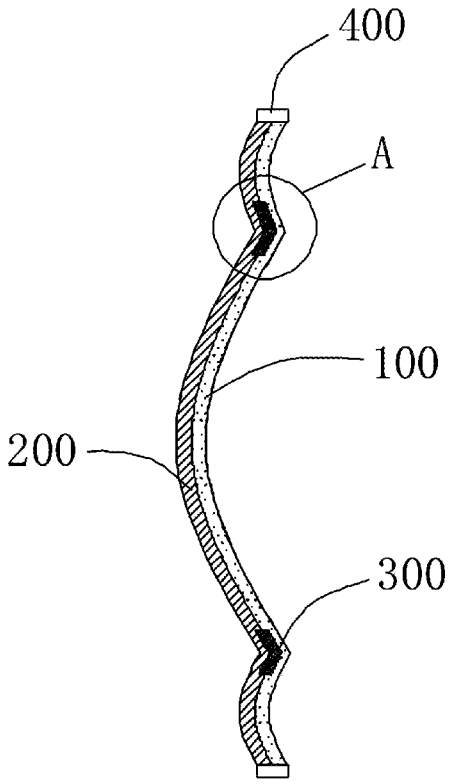
FIG. 2 is a cross-section schematic view of the first embodiment of the vibrating membrane for speakers as claimed in the invention.

In reference to the structure of the first embodiment of the vibrating membrane for speakers as shown in FIG. 1 and FIG. 2, the said composite platy layer 300 is disposed at the transitional part between the circular top 1 and the edge 2. It is in an arrow shape.

In such an embodiment, the composite platy layer 300 and the bottom layer 100 could all be a thin-film platy assembly made of polyester resin. Further, the composite metal layer 200 is also in a platy shape on whose layer a copper ring 400 is disposed which can ensure the elasticity and hardness of the vibrating membrane.

Figure 3:
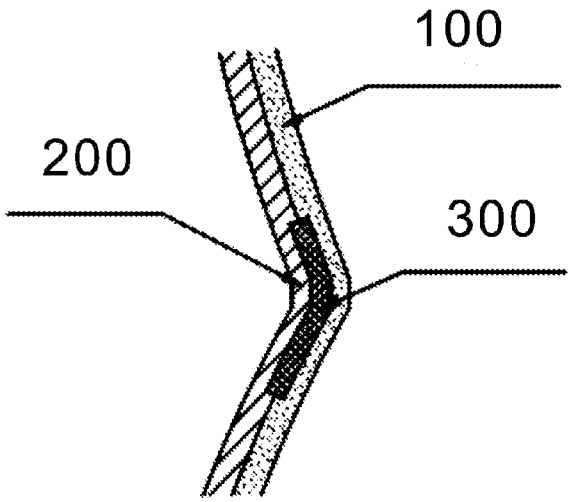
FIG. 3 is an enlarged view of Part A as shown in FIG. 2 of the vibrating membrane for speakers as claimed in the invention.

The vibrating membrane for speakers as claimed in the invention is divided into three layers as shown in FIG. 3: the first is the bottom layer 100 used to reinforce the low frequency, the second is the composite platy layer 300 used for HF compensation and the third is the composite metal layer 200 which could enable excellent transient response, ensure vibration uniformity and obtain flat response in the working area, while eliminating MF (medium frequency) and HF (high frequency) resonance to meet the full frequency band requirements of the headphone speakers.

Figure 4:
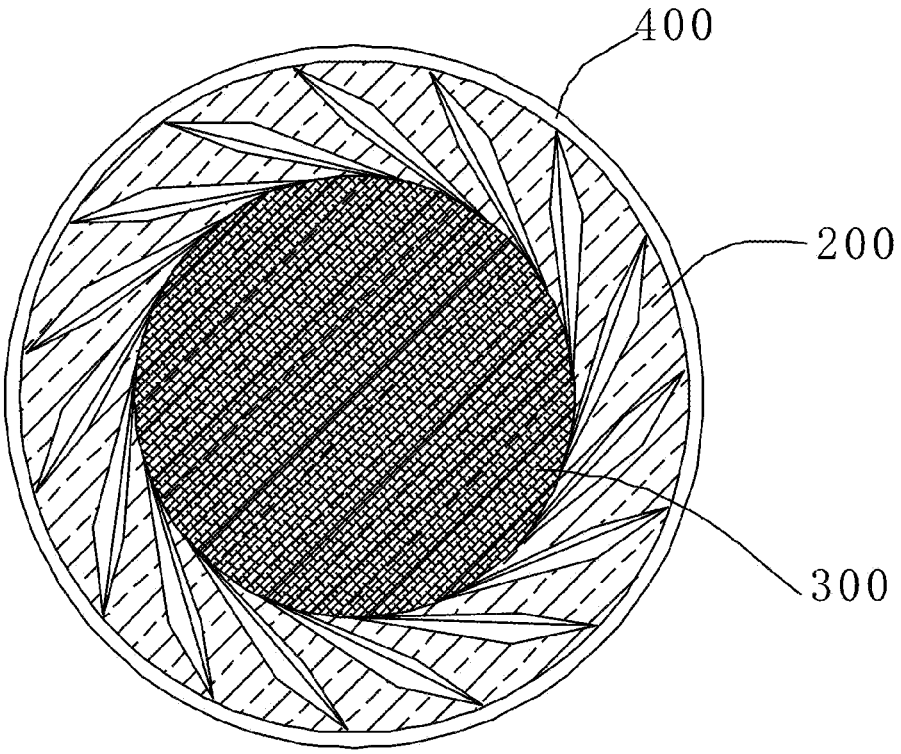
FIG. 4 is a schematic view of the second embodiment of the vibrating membrane for speakers as claimed in the invention.
Figure 5:
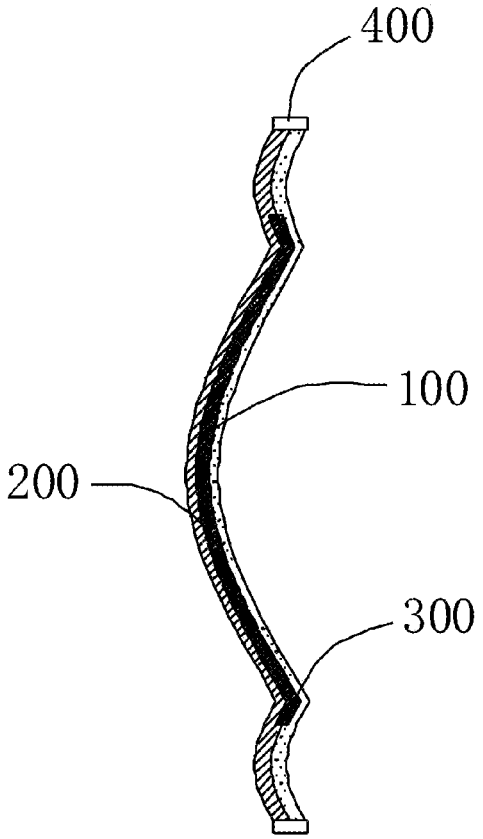
FIG. 5 is a cross-section schematic view of the second embodiment of the vibrating membrane for speakers as claimed in the invention.

In reference to the structure of the second embodiment of the vibrating membrane for speakers as shown in FIG. 4 and FIG. 5, such an embodiment differs from the foregoing structure in that: the composite platy layer 300 is disposed on the entire circular top 1 and its edges at both ends extend to the transitional part between the circular top 1 and the edge 2. In other words, the composite platy layer 300 in such an embodiment covers a larger cross-sectional area and a wider coverage and features bending resistance, less deformation liability and other unexpected properties apart from excellent transient response, vibration uniformity, flat response in the working area, and elimination of MF (medium frequency) and HF (high frequency) resonance to meet the full frequency band requirements of the headphone speakers.

It could be understood such that in such an embodiment, the composite platy layer 300 and the bottom layer 100 could all be a thin-film platy assembly made of polyester resin. Further, the composite metal layer 200 is also in a platy shape on whose layer a copper ring 400 is disposed which can ensure the elasticity and hardness of the vibrating membrane.

Figure 6:
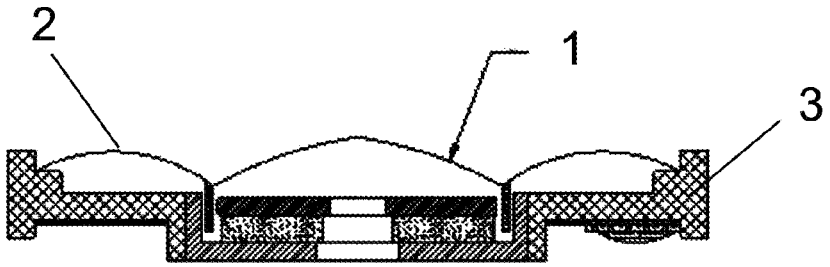
FIG. 6 is a schematic view of a preferred embodiment of the speaker as claimed in the invention.

A type of speaker with the structure of the said vibrating membrane for speakers is also disclosed in the invention and as shown in FIG. 6, which comprises a frame 3 used to support the vibrating membrane in which the said vibrating membrane for speakers is disposed.

Specifically, two kinds of embodiment can be adopted such that, the composite platy layer 300 could be disposed either at the transitional part between the circular top 1 and the edge 2 or on the entire circular top 1 and its edges at both ends extend to the transitional part between the circular top 1 and the edge 2. In both structures, the composite platy layer 300 is supported with a voice coil which is disposed inside the magnetic gap of the magnetic path.

The embodiment of the speaker as claimed in the invention is same as that of the said vibrating membrane for speakers and will not be detailed herein.

The embodiment of the vibrating membrane for speakers and the speaker using the said vibrating membrane as claimed in the invention could be such that, since the vibrating membrane for speakers is divided into three layers: the first is the bottom layer used to reinforce the low frequency, the second is the composite platy layer used for HF compensation and the third is the composite metal layer, wherein the former could be disposed either at the transitional part between the circular top 1 and the edge 2 or on the entire circular top 1 and its edges at both ends extend to the transitional part between the circular top 1 and the edge 2. The application could be such as to enable excellent transient response, ensure vibration uniformity and obtain flat response in the working area; eliminate MF (medium frequency) and HF (high frequency) resonance to meet the full frequency band requirements of the headphone speaker; boast good flexural behavior to make the speaker structure more stable and less prone to deformation, thereby extending the service life and promoting the quality of the product.

Only the preferred embodiments of the invention are disclosed which surely are not intended to limit the scope of protection of the invention. Therefore, equivalent changes made in accordance with the Claims of the invention are still covered within the scope of the invention.

The invention claimed is:

1. A type vibrating membrane for speakers comprising the vibrating membrane body is disclosed in the invention, which is characterized in that, the said vibrating membrane body comprises: a bottom layer used to reinforce the low frequency, a surface disposed on the said bottom layer, a composite metal layer used to ensure vibration uniformity, and a composite platy layer used for high frequency compensation disposed between the said bottom layer and the said composite metal layer.

2. The vibrating membrane for speakers according to claim 1 is characterized in that, the said vibrating membrane body comprises a circular top and the edge extended along the periphery of the said circular top.

3. The vibrating membrane for speakers according to claim 2 is characterized in that, the said composite platy layer is disposed on the said circular top and its edges extend to the transitional part between the said circular top and the said edge.

4. The vibrating membrane for speakers according to claim 2 is characterized in that, the said composite platy layer is disposed at the transitional part between the said circular top and the said edge.

5. The vibrating membrane for speakers according to claim 2 is characterized in that the said vibrating membrane body is in a single membrane structure.

6. The vibrating membrane for speakers according to claim 3 is characterized in that the said composite platy layer comprises a thin-film composite platy layer made of polyester resin.

7. The vibrating membrane for speakers according to claim 3 is characterized in that the said bottom layer comprises a thin-film bottom layer made of polyester resin.

8. The vibrating membrane for speakers according to claim 1 is characterized in that a copper ring is disposed on the edge of the said composite metal layer.

9. A type speaker comprising a frame used to support the vibrating membrane for speakers is disclosed in the invention, which is characterized in that, a vibrating membrane for speakers as claimed in claim 1 is disposed inside the frame.

10. The vibrating membrane for speakers according to claim 4 is characterized in that the said composite platy layer forms a ring in the transitional part, and the transitional part comprises a crease.

* * * * *